US005273400A

United States Patent [19]

Amr

[11] Patent Number: 5,273,400

[45] Date of Patent: Nov. 28, 1993

[54] AXIAL FLOW FAN AND FAN ORIFICE

[75] Inventor: Yehia M. Amr, Manlius, N.Y.

[73] Assignee: Carrier Corporation, Syracuse, N.Y.

[21] Appl. No.: 836,437

[22] Filed: Feb. 18, 1992

[51] Int. Cl.[5] ..... B63H 7/02

[52] U.S. Cl. ..... 416/189; 416/179; 416/169 A; 416/192; 416/242; 416/DIG. 5

[58] Field of Search ..... 416/189, 179, 169 A, 416/192, 223 R, 242, DIG. 5, DIG. 2

[56] References Cited

U.S. PATENT DOCUMENTS

| | | | |
|---|---|---|---|
| 4,211,514 | 7/1980 | Hawes | 416/169 A |
| 4,358,245 | 11/1982 | Gray | 416/189 |
| 4,548,548 | 10/1985 | Gray, III | 416/192 |
| 4,569,631 | 2/1986 | Gray, III | 416/189 |
| 4,684,324 | 8/1987 | Perosino | 416/189 |
| 4,840,541 | 6/1989 | Sakane et al. | 416/223 |
| 4,900,229 | 2/1990 | Brackett et al. | 416/189 |
| 4,915,588 | 4/1990 | Brackett | 416/189 |
| 4,971,520 | 11/1990 | Van Houten | 416/DIG. 5 |

*Primary Examiner*—Richard A. Bertsch
*Assistant Examiner*—Mark Sgantzos

[57] ABSTRACT

A low noise axial flow fan (10/110) having a plurality of identical blades (13/113) extending from a central hub (11/111). In a preferred embodiment, each blade is highly skewed, having a backward (with respect to fan rotation direction) skew in the root portion (15/115) of the blade nearest the hub, changing to a highly forward skew in the portion (16/116) of the blade near the tip. The fan may be shrouded or unshrouded. In the shrouded embodiment, the fan (110) is used in conjuncton with an inlet orifice structure (131). Each blade of the fan has a chord length (Ch) that increases from root (17/117) to tip (18/118), a pitch angle (Γ) that decreases from roto to tip and a camber angle (Ca) that decreases from root to tip. In the shrouded embodiment (110), both the contour of the inlet portion (126) of the shroud and the contour of the inlet portion (132) of the orifice structure are quarter sections of ellipses.

12 Claims, 5 Drawing Sheets

AXIAL FLOW FAN AND FAN ORIFICE

BACKGROUND OF THE INVENTION

This invention relates generally to fans for moving air. More particularly, the invention relates to an improved axial flow fan. The fan may either be shrouded or unshrouded. The embodiment of the invention that includes a shrouded fan also includes a fixed orifice to be used in conjunction with the fan.

Axial flow fans are used to cause air movement in a wide variety of applications, including building heating, ventilating and cooling systems and engine cooling systems, to name just a few.

In most applications, the air stream entering a fan is nonuniform and turbulent. These conditions result in unsteady air flow at the leading edge of the fan blade and pressure fluctuations on the surface of the blade. These pressure fluctuations are responsible for noise that is radiated from the fan. The sound level of the noise produced by the blade is a function of the relative velocity between the air and the fan blade. The relative velocity, in turn, increases with linear blade speed, which is a function of fan rotational speed and distance on the blade from the fan center of rotation. Radiated noise from the fan also increases with local blade loading, which is a function of the amount of work being done at a particular location on the blade, the pitch and camber of the blades and blade solidity (that is, the total area of the swept disk of the fan covered by blade).

In general, a quiet fan is also an efficient fan, having a lower input power requirement for moving a given amount of air as compared to noisier fans.

Advances in materials technology and fabrication techniques have led to the use of plastics in a wide variety of new applications. Modern plastics can be strong, durable, damage resistant, lightweight and competitive in manufacturing cost with other materials. Moreover, the ability to easily mold plastic material has enabled the mass production of components in complex shapes that have previously been difficult and uneconomical to manufacture.

SUMMARY OF THE INVENTION

The present invention is an axial flow fan capable of use in a variety of applications including moving air in heating, ventilation and air conditioning systems and equipment. It produces reduced levels of radiated noise and requires lower input power to move the same amount of air as compared to prior art fans.

The fan has a plurality of identical blades. Each blade is strongly swept in one direction at its root and strongly swept in the other direction at its tip. This combination of blade sweeps allows for a large amount of sweep at the blade tip while producing low stress in the blade at its root. A large sweep in the tip region of the blade results in low turbulent noise coherence in that region. The coherence is low because only a relatively small portion of the blade tip region is subjected to inlet flow turbulence at any given instant.

The noise produced by inlet turbulence is thus diffused and reduced.

Both the blade camber and pitch decrease from blade root to tip. The root portion of the blade therefore does the majority of the work of the fan and, in the tip region, the air undergoes relatively less turning as it passes through the fan and the blade loading is less. Since the tip region is usually the major noise source in a fan, this configuration results in a fan that is quieter.

Along the entire span of the blade, the maximum camber, expressed as the deviation of the blade camber line from the chord line, of the blade should be closer to the leading edge of the blade. This configuration promotes attached flow in the region of the trailing edge and thus reduces form drag and trailing edge noise.

The fan may be shrouded or unshrouded. The unshrouded embodiment is appropriate for use in an application where the fan is not encircled by a duct or fixed orifice or where the clearance between the blade tips and the duct or orifice can be accurately controlled and made small to reduce tip leakage. The shrouded embodiment is appropriate in an application in which there is a fixed orifice associated with the fan installation and the clearance between fan and orifice must be relatively large.

In the shrouded embodiment, the fan shroud has an inlet portion that has an elliptical internal cross section. For optimum results, the fixed orifice should be configured so as to complement the fan configuration. The fixed orifice of the present invention has a throat diameter that is the same as the inner diameter of the fan shroud and an inlet portion that also has an elliptical internal cross section. The orifice and shroud in combination serve to minimize turbulence in the air stream entering the fan.

The number of blades on a fan constructed according to the present invention is not critical to fan efficiency, noise and overall performance. The fewer the number of blades, however, the greater the pitch that will be required in order for the fan to produce a given capacity at a given rotational speed. Fewer blades would also require increased mid chord skew angles and larger blade chord lengths to achieve a desired blade solidity (that is, the proportion of the total area of the swept disk of the fan that is covered by blades).

The fan and orifice of the present invention may be manufactured out of any suitable material by any suitable process. It is however, particularly suited, assuming no blade overlap, to be produced in a suitable plastic by a suitable molding process.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Note that in the description that follows, the terms "forward," "backward," "leading" and "trailing," all with respect to the direction of rotation of the fan, are used to describe the sweep and certain features of a blade of the fan of the present invention. It is apparent that if the fan were to rotate in the opposite direction, then terms reverse and, for example, "forward sweep" becomes "backward sweep" with respect to the new direction of rotation. One of ordinary skill in the art will readily apprehend that most of blade tip sweep can be achieved regardless of the direction of sweep relative to direction of rotation. In a fan in which the blades and their configuration are not symmetrical, radiated noise is somewhat less when blade tip sweep is in the direction of fan rotation (forward sweep) than when the sweep is is in the direction opposite to rotation (backward sweep). The fan of the present invention does exhibit somewhat better performance when the tip portion of the blades sweep forward with respect to the rotational direction. But the difference is small and the performance of such a fan having backward sweep in the tip region in terms of noise, capacity and efficiency is still excellent. Regardless of sweep direction, in the shrouded embodiment of the fan the elliptical portion of the fan shroud should be on the side of the shroud that faces the incoming air stream.

Figure 1B:
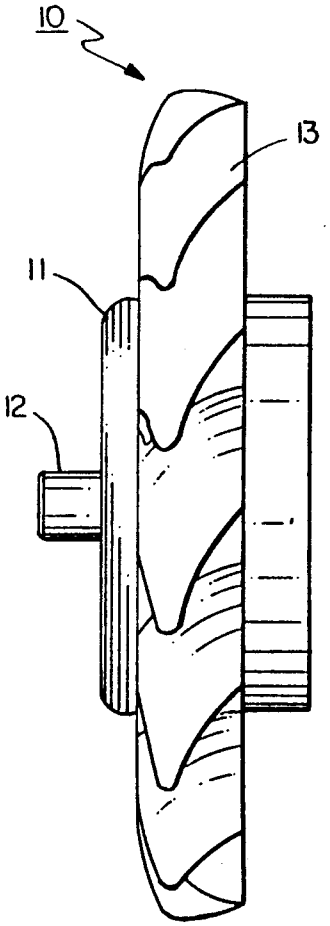
FIGS. 1A and 1B are, respectively, a front and a side elevation view of one embodiment of the fan of the present invention.
Figure 1A:
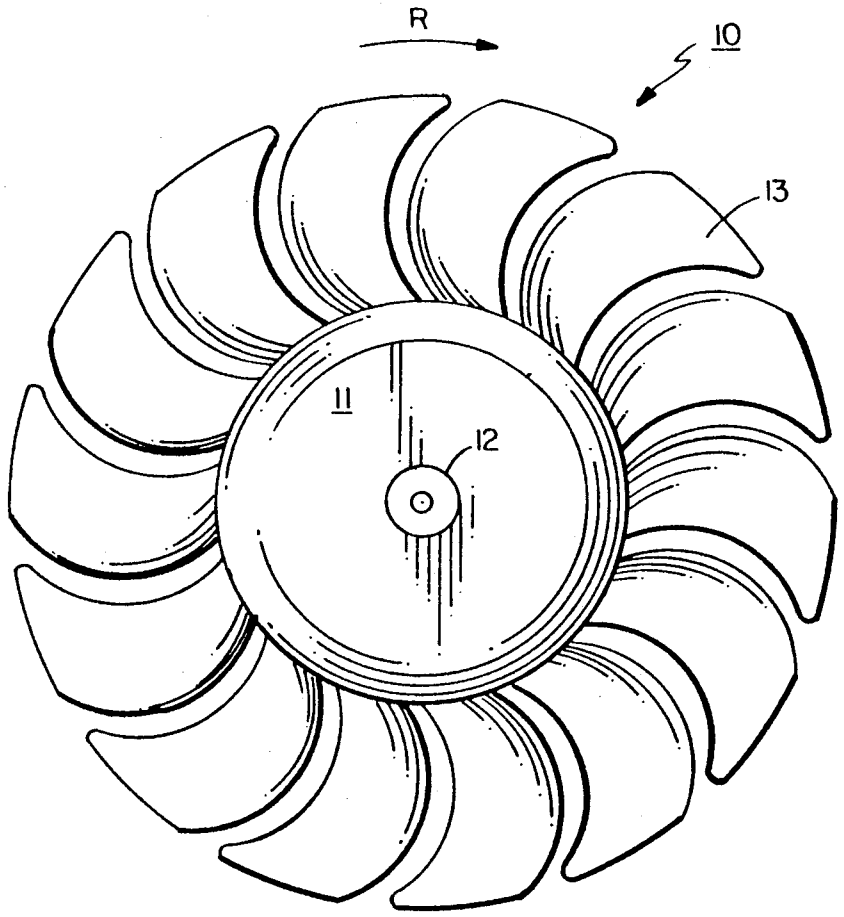

Shown in FIGS. 1A and 1B are, respectively, a front and side elevation view of one embodiment of the fan of the invention. Fan 10 has hub 11 to which are attached a number of blades 13. Hub 11 may have boss 12 at its center. When in operation, fan 10 rotates in direction R. All of the blades of fan 10 are identical. Each blade is swept backward, with respect to the direction of rotation of the fan, in its root portion and swept forward in its tip portion. FIG. 1A shows fan 10 to have 14 blades. The number of blades is not critical to the attainment of performance objectives. But 14 is a convenient number which, when considering the configuration of each blade, allows for high solidity but no blade overlap, thus making possible the manufacture of the fan in plastic using an injection molding process.

Figure 2A:
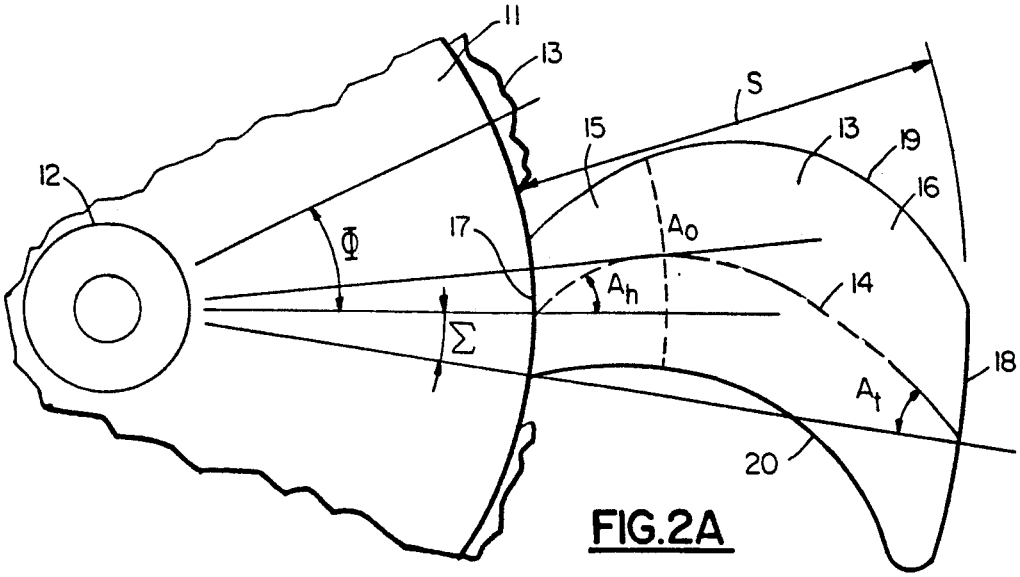
FIGS. 2A and 2B are front elevation views, partially broken away, showing a portion of the hub and one blade of one embodiment of the fan of the present invention but respectively showing different features of the fan blade.

FIG. 2A illustrates several features of the fan of the invention. The figure is a partial front elevation view of fan 10 showing hub 11 and blade 13. Blade 13 has root 17, where the blade meets and attaches to the hub, and tip 18, which is the outer extremity of the blade. Blade 13 also has leading edge 20 and trailing edge 19. Line 14 is the blade midchord line, which is the locus of points that are circumferentially equidistant from leading edge 20 and trailing edge 19. Blade 13 has span s, the radial distance from hub 11 to tip 18. Blade 13 can be divided into root portion 15 and tip portion 16.

In root portion 15 of blade 13, midchord line 14 has a backward sweep with sweep angle $A_h$ at the hub. At the transition from the root portion to the tip portion of the blade, midchord line 14 has zero sweep $A_0$. At the tip of blade 13, midchord line 14 has a forward sweep with sweep angle $A_t$. Midchord skew angle $\Sigma$ is the angle between a radius of the swept disk of fan 10 that intersects root 17 at the same point as does midchord line 14 and another radius of the swept disk that intersects tip 18 at the same point as does midchord line 14. Blade spacing angle $\Phi$ is the angular displacement between a fan radius passing through any given point on a blade and a fan radius passing through the corresponding point on an adjacent blade. For the 14 bladed fan depicted in FIGS. 1A and 1B, $\Phi$ is 360°/14 or 25.7°.

Figure 2B:
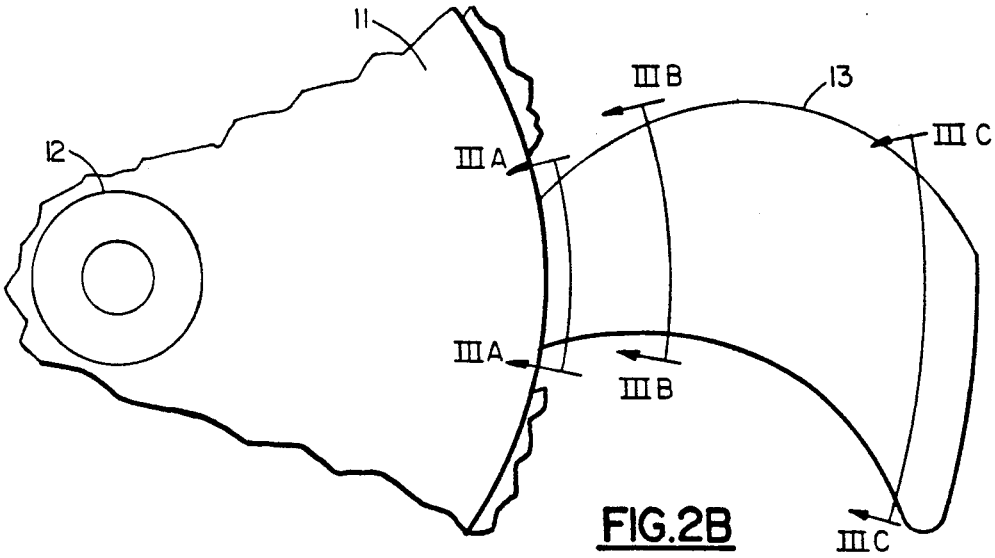
Figure 3A:
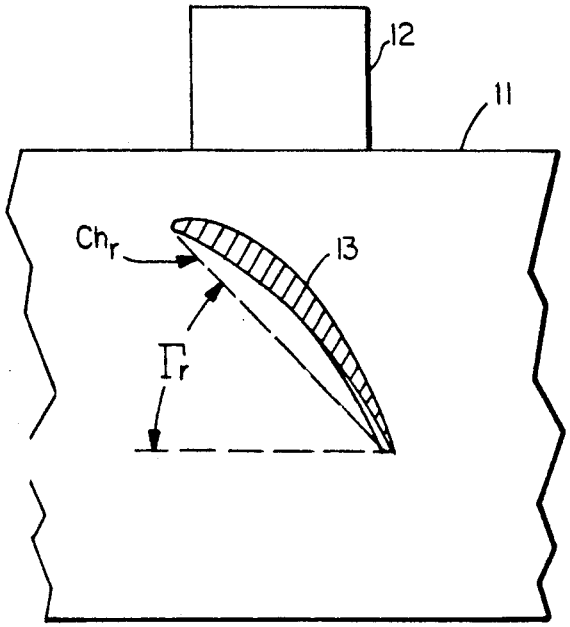
FIGS. 3A through 3C are cylindrical Cross sectional views, taken at lines IIIA—IIIA, IIIB—IIIB and IIIC—IIIC in FIG. 2B, of the blade of the fan of one embodiment of the present invention.
Figure 3B:
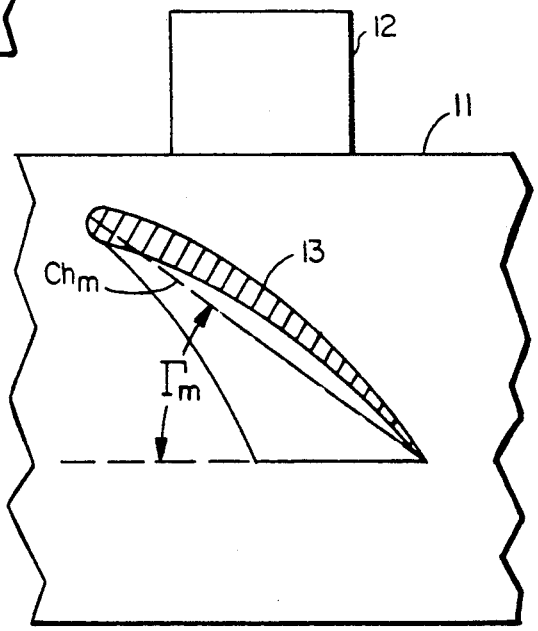
Figure 3C:
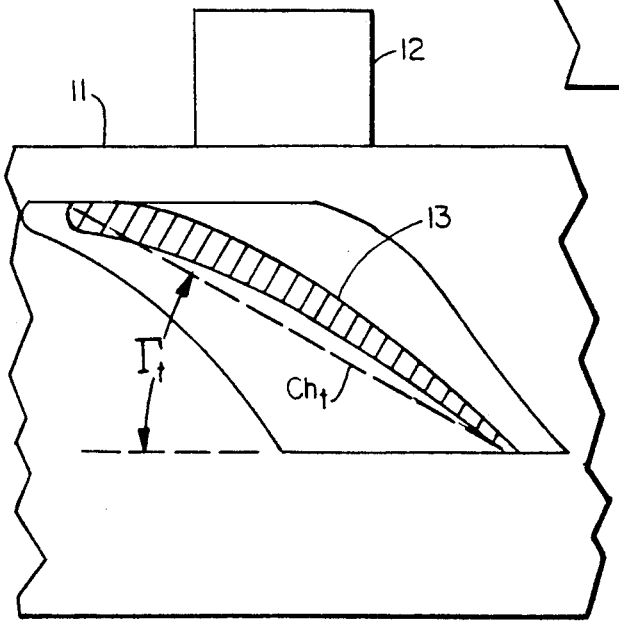

FIG. 2B again illustrates blade 13 of fan 10 but in that FIG. are shown lines IIIA—IIIA, IIIB—IIIB and IIIC—IIIC that are, respectively, the circumferential lines that define the cylindrical sections shown in FIGS. 3A, 3B and 3C.

FIG. 3A shows a cylindrical cross section of blade 13 taken at blade root 17 (FIG. 2A), line IIIA—IIIA in FIG. 2B. At its root, blade 13 has pitch angle $\Gamma_r$ and chord $Ch_r$. FIG. 3B shows a cylindrical cross section of the middle section of blade 13 taken through line IIIB—IIIB in FIG. 2B. In that portion of blade 13, the blade has pitch angle $\Gamma_m$ and chord $Ch_m$. FIG. 3C shows a cylindrical cross section of blade 13 taken at blade tip 18 (FIG. 2A), line IIIC—IIIC in FIG. 2B. At its tip, blade 13 has pitch angle $\Gamma_t$ and chord $Ch_t$.

Figure 4:
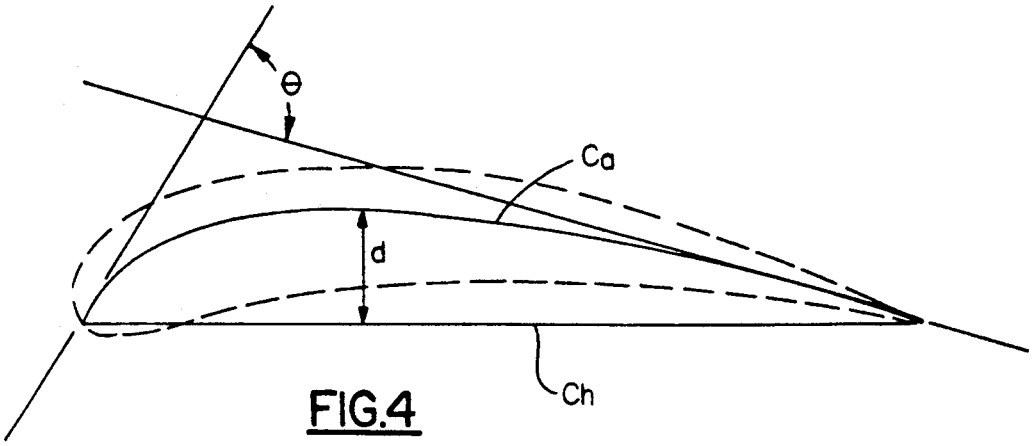
FIG. 4 is a diagram showing relationships between the chord and camber of the blade of the fan of the present invention.

FIG. 4 depicts diagrammatically a typical cylindrical cross section of blade 13. In the figure is shown the blade camber line Ca and chord Ch. Dimension d is the amount of deviation of camber line Ca from chord Ch. Lines tangent to camber line Ca intersect at its intersections with chord Ch intersect, forming camber angle $\theta$.

Figure 5B:
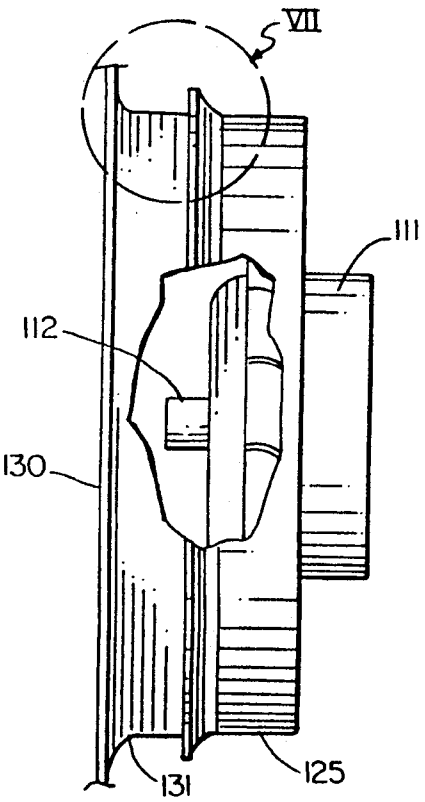
FIGS. 5A and 5B are, respectively front and side elevation views of the fan and fan orifice of another embodiment of the present invention.
Figure 5A:
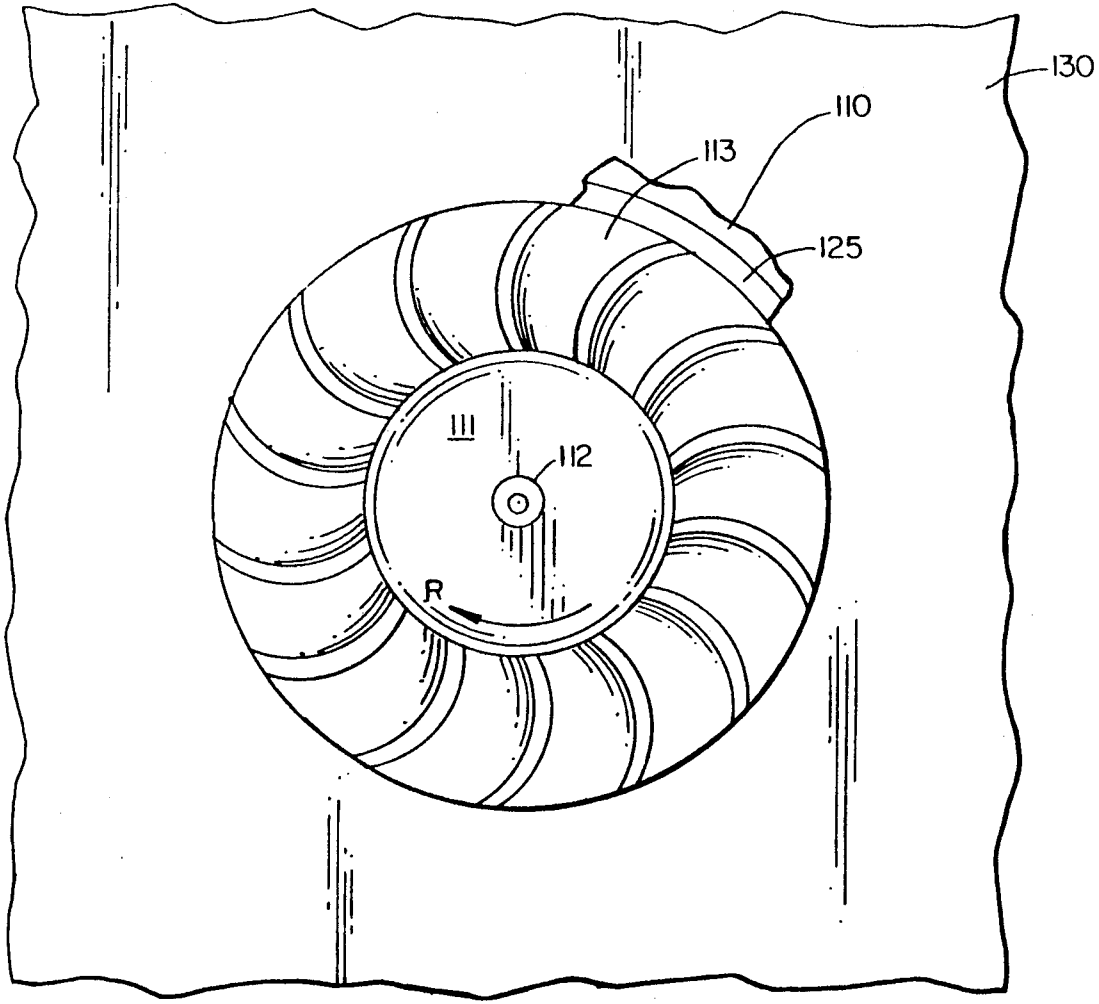

FIGS. 5A and 5B depict in front and side elevation Views, respectively, another embodiment of the present invention. That embodiment differs from the embodiment shown in FIGS. 1A and 1B in that the fan has a shroud fixed to and rotating with it. In addition, a specially configured orifice can be fitted in conjunction with the shrouded fan to direct air flow into the fan. FIGS. 5A and 5B show fan 110 mounted behind and coaxially with orificed bulkhead 130. Fan 110 in all significant details identical to fan 10 (FIGS 1A and 1B) except that fan 110 has shroud 125 surrounding and affixed to the tips of blades 113. Orificed bulkhead 130 has orifice 131 passing through it.

Figure 6:
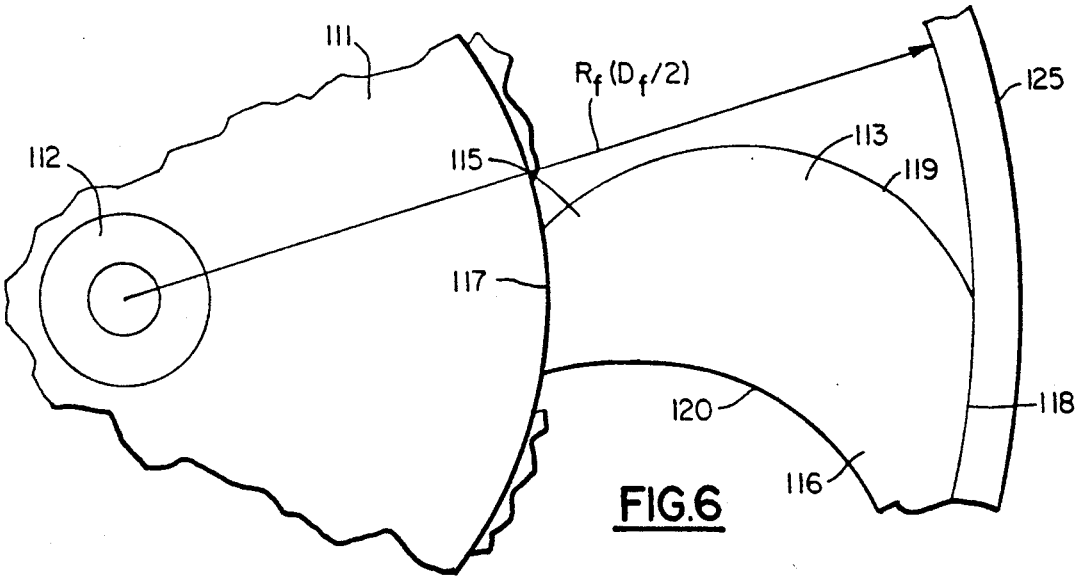
FIG. 6 is a front elevation view, partially broken away, of a portion of the hub and one blade of the embodiment of the fan of the present invention shown in FIGS. 5A and 5B.

In the manner of FIG. 2A, FIG. 6 is a partial front elevation view of fan 110 showing blade 113 and a portion hub 111 as well as boss 112. Blade 113 has root 117, where the blade meets and attaches to the hub, and tip 118, which is the outer extremity of the blade. Blade 113 also has leading edge 120 and trailing edge 119. Blade 113 can be divided into root portion 115 and tip portion 116. The limits of root portion 115 and tip portion 116 are, respectively, the same as the limits of root portion 15 and tip portion 116 shown in FIG. 2A. $R_f$ is the fan radius, or one half fan diameter Df.

Figure 7:
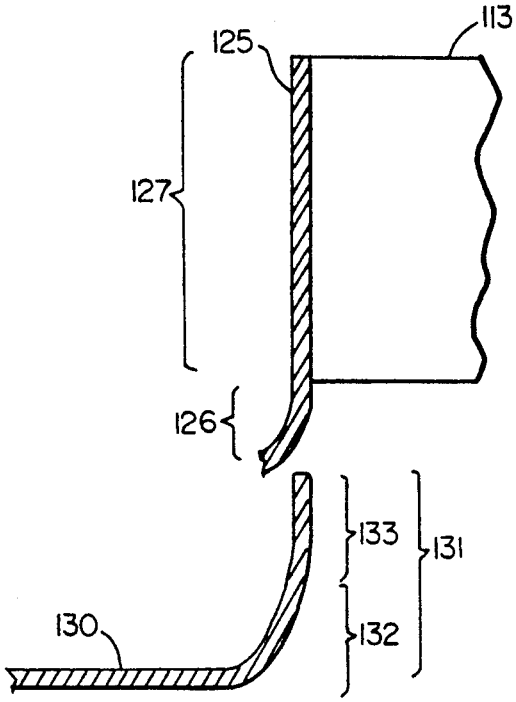
FIG. 7 is a sectioned partial elevation view of the rotating shroud and fixed orifice of an embodiment of the present invention.

FIG. 7 is an expanded view, in cross section, of the portion of shroud 125 and orifice 131 highlighted in FIG. 6. Main section 127 of shroud 125 is generally cylindrical in cross section and is attached to blade 113 along its interior surface. Inlet section 126 of shroud 125 flares out from main section 127. The cross section of inlet section 126 is that of a quarter section of an ellipse having a major axis that is parallel to the axis of rotation of fan 110. Inlet section 132 of orifice 131 has a cross section that is similarly a quarter section of an ellipse having a major axis that is parallel to the axis of orifice 131 and thus also to the axis or rotation of fan 110. Throat portion 133 of orifice 131 is generally cylindrical and has the same inner diameter as the inner diameter of main section 127 of shroud 125. The clearance between shroud 125 and orifice 131 should be as small as manufacturing and operational considerations will allow. There are certain optimum relationships between the axes of the ellipses that define the contours of inlet section 126 of shroud 115 and inlet section 132 of orifice 131 and between those axes and other fan parameters. In the description and discussion below, the major and minor axes of the ellipse that defines the contour of inlet portion 126 of shroud 125 are designated $A_{Ms}$ and $A_{ms}$ respectively. Similarly the major and minor axes of the ellipse that defines the contours of inlet section 132 of orifice 131 are designated $A_{Mo}$ and $A_{mo}$ respectively.

Theoretical work and laboratory tests have shown that in the preferred embodiments of both unshrouded fan 10 and shrouded fan 110:

(a) the sweep of midchord line 14 should be backward between 20 and 30 degrees at root 17/117 of blade 13/113, then smoothly decrease to zero sweep at a point 25 to 50 hundredths of blade span s from root 17/117 and then smoothly increase to 40 to 70 degrees at tip 18/118 or $$A_r = 20° \text{ to } 30°,$$

$$A_o = 0 \text{ at } (0.25 \text{ to } 0.5)s, \text{ and}$$

$$A_t = 40° \text{ to } 70°;$$

(b) mid chord skew angle $\Sigma$ should be 5 to 6 tenths of blade spacing angle $\Phi$ or $$\Sigma = (0.5 \text{ to } 0.6)\Phi;$$

(c) blade pitch angle $\Gamma$ should decrease from blade root 17/117 to blade tip 18/118 or $$\Gamma_r > \Gamma_m > \Gamma_t;$$

(d) blade chord length Ch should increase from blade root 17/117 to blade tip 18/118 or $$Ch_r < Ch_m < Ch_t;$$

(e) blade camber angle Ca should decrease from blade root 17/117 to blade tip 18/118 or $$\theta_r \leqq \theta_t; \text{ and}$$

(f) deviation d of blade camber line Ca from blade chord Ch should be at its maximum at a point that is 30 to 45 hundredths of the length of blade chord Ch from blade leading edge 20/120.

Similarly, theoretical and practical work have shown that in the shrouded embodiment, that is, fan 110 with associated orifice 131:

(a) the major axis of the ellipse, a quarter section of which defines the contour of inlet section 126 of shroud 127 should have a major axis that is fifteen to fifty thousandths of fan diameter $D_f$ and a minor axis that is five to eight tenths of that major axis or $$A_{Ms} = (0.015 \text{ to } 0.05)D_f \text{ and}$$

$$A_{ms} = (0.5 \text{ to } 0.8)A_{Ms}; \text{ and}$$

(b) the major axis of the ellipse, a quarter section of which defines the contour of inlet section 132 of orifice 131 should have a major axis that is five to ten hundredths of diameter $D_f$ of associated fan 110 and a minor axis that is five to eight tenths of that major axis or $$A_{Mo} = (0.05 \text{ to } 0.1)D_f \text{ and}$$

$$A_{mo} = (0.5 \text{ to } 0.8)A_{Mo}.$$

A prototype fan having the above described configuration has been built and tested. The prototype produced the same air flow with a reduction in radiated noise of 8 dBA and a reduction in fan input power required of 25 percent compared to a prior art fan now in widespread use.

What is claimed is:

1. An axial flow fan (10) comprising;
a central hub (11) and
a plurality of blades (13) extending from said hub, each of said blades having
a root (17),
a tip (18),
a root portion (15) within which the mean line (14) of said blade is swept in a first direction with respect to the direction of rotation of said fan,
a tip portion (16) within which the mean line of said blade is swept in a second direction opposite to said first direction with respect to the direction of rotation of said fan,
a variable pitch ($\Gamma$) that decreases from said root to said tip,
a variable chord (Ch) that increases from said root to said tip and
a variable camber angle ($\theta$) that decreases from said root to said tip.

2. The fan of claim 1 in which the sweep of said blade mean line at said root ($A_h$) is twenty to thirty degrees (20°-30°), the sweep of said blade mean line at said tip ($A_t$) is forty to seventy degrees (40°-70°),
the point of zero sweep of said blade mean line ($A_0$) is located axially twenty five to fifty hundredths of (0.25-0.5 times) the span (S) of said blade from said root and
the mid chord skew angle ($\Sigma$) of said blade is five to six tenths (0.5-0.6 times) the angular spacing between adjacent blades.

3. The fan of claim 1 further comprising
a leading edge (13) and in which
the maximum deviation of the camber line (Ca) of said blade from said chord occurs at between thirty to forty five hundredths of (0.3-0.45 times) the length of said chord from said leading edge.

4. The fan of claim 1 further comprising
a circumferential shroud (115) surrounding and fixed to said blades at said tips, said shroud having
an inlet section (126) that is, in all sections made by planes passing through the axis of rotation of said fan, a quarter section of an ellipse, said ellipse having a major axis that is parallel to said fan axis of rotation and
a cylindrical main section (127).

5. An axial flow fan (110) and fan inlet orifice structure (121) comprising
a shrouded axial flow fan having
a central hub (111),
a plurality of blades (113) extending from said hub, each of said blades having
a root (117), a tip (118), a root portion (115) within which the mean line of said blade is swept backward with respect to the direction of rotation of said fan, a tip portion (116) within which the mean line of said blade is swept forward with respect to the direction of rotation of said fan, a variable pitch (Γ) that decreases from said root to said tip, a variable chord (Ch) that increases from said root to said tip, a variable camber angle (θ) that decreases from said root to said tip and a circumferential shroud (115) surrounding and fixed to said blades at said tips, said shroud having an inlet section (126) that is, in all sections made by planes passing through the axis of rotation of said fan, a quarter section of an ellipse, said ellipse having a major axis that is parallel to said fan axis of rotation and a cylindrical main section (127); and an orifice (121) that comprises a wall structure having a central axis that is, when assembled with said fan, coincident with said fan axis of rotation, an inlet portion (132) that is, in all sections made by planes passing through said central axis, a quarter section of an ellipse, said ellipse having a major axis that is parallel to said central axis and a cylindrical throat section (133) that has the same inner diameter as said cylindrical main section of said circumferential shroud.

6. The fan and orifice structure of claim 5 in which the sweep of said fan blade mean line at said root ($A_h$) is twenty to thirty degrees (20°-30°), the sweep of said fan blade mean line at said tip ($A_t$) is forty to seventy degrees (40°-70°), the point of zero sweep of said fan blade mean line ($A_0$) is located axially twenty five to fifty hundredths of (0.25 to 0.50 times) the span (S) of said blade from said root and the mid chord skew angle (Σ) of said fan blade is five to six tenths of (0.5 to 0.6 times) the angular spacing between adjacent blades.

7. The fan and orifice structure of claim 5 in which the maximum deviation of the camber line (Ca) of said blade from said its chord occurs at between thirty five to forty hundredths of (0.3 to 0.45 times) the chord length from the blade leading edge.

8. The fan and orifice structure of claim 5 in which the ellipse, a quarter of which defines the contour of said inlet section (126) of said fan shroud, has a major axis ($A_{Mf}$) that is fifteen to fifty thousandths of (0.015 to 0.05 times) the fan diameter ($D_f$) and a minor ($A_{mf}$) axis that is five to eight tenths of (0.5 to 0.8 times) said major axis ($A_{Mf}$) and the ellipse, a quarter of which defines the contour of said inlet portion (132) of said orifice structure, has a major axis ($A_{Mo}$) that is five to ten hundredths of (0.05 to 0.1 times) the fan diameter ($D_f$) and a minor axis ($A_{mo}$) that is five to eight tenths (0.5-0.8) of said major axis ($A_{mo}$).

9. An axial flow fan (10) comprising:

a central hub (11); and a plurality of blades (13) extending from said hub, each of said blades having a root (17), a tip (18), a root portion (15) within which the mean line (14) of said blade is swept in a first direction with respect to the direction of rotation of said fan, a tip portion (16) within which the mean line of said blade is swept in a second direction opposite to said first direction with respect to the direction of rotation of said fan, a variable pitch (Σ) that decreases from said root to said tip, a variable chord (Ch) that increases from said root to said tip, a variable camber angle (θ) that decreases from said root to said tip, the backward sweep of said blade mean line at said root ($A_h$) is twenty to thirty degrees (20°-30°), the forward sweep of said blade means line at said root ($A_t$) in twenty to thirty degrees (40°-70°), the point of zero sweep of said blade means line ($A_0$) is located axially twenty five to fifty hundredths of (0.25-0.5 times) the span (S) of said blade from said root; and the mid chord skew angle (Σ) of said blade is five to six tenths (0.5-0.6 times) the angular spacing between adjacent blades.

10. The fan of claim 9 further comprising a leading edge (13)

and in whcih the maximum deviation of the camber line (Ca) of said blade from said chord occurs at between thirty to forty five hundredths of (0.3-0.45 times) the length of said chord from said leading edge.

11. An axial flow fan (110) and fan inlet orifice structure (121) comprising:

a shrouded axial flow fan having a central hub (111), a plurality of blades (113) extending from said hub, each of said blades having a root (117), a tip (118), a root portion (115) within which the mean line of said blade is swept backward with respect to the direction of rotation of said fan, a tip portion (116) within which the means line of said blade is swept forward with respect to the direction of rotation of said fan, a variable pitch (Γ) that decreases from said root to said tip, a variable chord (Ch) that increases from said root to said tip, a variable camber angle (74 ) that decreases from said root to said tip, the swept of said fan blade means line at said root ($A_h$) is twenty to thirty degrees (20°-30°), the sweep of said fan blade mean line at said tip ($A_t$) is forty to seventy degrees (40°-70°), the point of zero sweep of said fan blade means line ($A_0$) is located axially twenty five to fifty hundredths of (0.25 to 0.50 times) the span (S) of said blade from said root and the mid chord skew angle (Σ) of said fan blade is five to six tenths of (0.5 to 0.6 times) the angular spacing between adjacent blades; and a circumferential shroud (115) surrounding and fixed to said blades at said tips, said shroud having an inlet section (126) that is, in all sections made by planes passing through the axis of rotation of said fan, a quarter section of an ellipse, said ellipse having a major axis that is parallel to said fan axis of rotation and a cylindrical main section (127); and an orifice (121) that comprises a wall structure having a central axis that is, when assembled with said fan, coincident with said fan axis of rotation, an inlet portion (132) that is, in all sections made by planes passing through said central axis, a quarter section of an ellipse, said ellipse having a major axis that is parallel to said central axis and a cylindrical throat section (133) that has the same inner diameter as said cylindrical main section of said circumferential shroud.

12. The fan and orifice structure of claim 11 in whcih the maximum deviation of the camber line (Ca) of said blade from said chord occurs at between thirty five to forty hundredths of (0.3 to 0.45 times) the chord length from the blade leading edge.

* * * * *